United States Patent [19]

Ujihara

[11] Patent Number: 4,742,894

[45] Date of Patent: May 10, 1988

[54] APPARATUS FOR CONTROLLING ELEVATOR

[75] Inventor: Hideyo Ujihara, Inazawa, Japan

[73] Assignee: Mitsubishi Denki Kabushiki Kaisha, Japan

[21] Appl. No.: 46,427

[22] Filed: May 6, 1987

[30] Foreign Application Priority Data

May 8, 1986 [JP] Japan ..... 61-105556

[51] Int. Cl.[4] ..... B66B 3/02

[52] U.S. Cl. ..... 187/136

[58] Field of Search ..... 187/134, 136

[56] References Cited

U.S. PATENT DOCUMENTS

| | | | |
|---|---|---|---|
| 4,102,437 | 7/1978 | Mandel | 187/136 |
| 4,368,518 | 1/1983 | Terazono et al. | 187/136 X |
| 4,389,631 | 6/1983 | Kajiyama et al. | 187/134 |
| 4,630,026 | 12/1986 | Lewis | 187/136 |

FOREIGN PATENT DOCUMENTS

| | | |
|---|---|---|
| 57-57391 | 12/1982 | Japan . |
| 58-144072 | 8/1983 | Japan . |

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

An apparatus for controlling an elevator comprising control data setting means for setting control data indicative of an environment where the elevator is installed and for generating a control signal representative thereof; cage position detecting means for detecting position of a cage of the elevator to generate a cage position signal representative thereof; cage position converter means connected to receive the control signal and the cage position signal for performing a predetermined logical operation to generate a converted cage position signal corresponding to the environment; position indicator data setting means for setting a position indicator data representing the position of the cage in response to the converted cage position signal generated by the cage position converter means; and position indicator signal producing means for producing a position indicator signal on the basis of the converted cage position signal and the position indicator data. The cage position converter element performs a predetermined logical operation in accordance with the position indicator data and the cage position signal indicative of a floor level of zero detected by the cage position detecting element.

9 Claims, 4 Drawing Sheets

APPARATUS FOR CONTROLLING ELEVATOR

BACKGROUND OF THE INVENTION

The present invention relates to an apparatus for controlling an elevator using a digital position indicator.

FIG. 4 is a diagram illustrating the structure of a conventional elevator control apparatus employing an electronic computer, wherein reference numeral 11 denotes a central processing unit, numeral 12 denotes a signal line which consists of an address bus, a data bus and a control bus, numeral 13 denotes a read-only memory (hereinafter referred to as program ROM) which stores program data for controlling the elevator, numeral 5 denotes a read-only memory (hereinafter referred to as data ROM) which stores control data used for a program, numeral 14 denotes a readable/writable memory (hereinafter referred to as RAM) which stores results calculated by the central processing unit 11, reference numeral 42 denotes a setter for setting control data specific to each building, such as the number of floors where the elevator is put into service, the entrance floor of the building, and the like, reference numerals 15 and 16 denote converters which perform such conversions as voltage level conversion of data that are sent to, or received from, the central processing unit 11, analog-to-digital conversion, and serial-parallel conversion, numeral 17 denotes a position indicator connected to the converter 15, and reference numeral 18 denotes elevator equipment connected to the converter 16. The above-mentioned the units are connected to one another through the signal line 12, except for the position indicator 17 and the elevator equipment 18.

FIG. 5 is a diagram showing the arrangement of the position indicator 17 having seven segments, wherein the segments $D_0$ to $D_7$ are each activated according to the number to be displayed. With reference to Table 1 which shows activation states of the bits and the displayed contents, when, for example, "—" is to be displayed, the only the segment "$D_6$" should be turned on (i.e. $D_6=1$). Therefore, the converter 15 should produce the data "0100 0000" (=40 in hexadecimal number). When "2" is to be displayed, the segments $D_0$, $D_1$, $D_3$, $D_4$ and $D_6$ must be turned on. Namely, the converter 15 should produce the data "0101 1011" (=5B in hexadecimal number).

TABLE 1

| Display | Bit | | | | | | | |
|---|---|---|---|---|---|---|---|---|
| | $D_7$ | $D_6$ | $D_5$ | $D_4$ | $D_3$ | $D_2$ | $D_1$ | $D_0$ |
| — | 0 | 1 | 0 | 0 | 0 | 0 | 0 | 0 |
| 1 | 0 | 0 | 0 | 0 | 0 | 1 | 1 | 0 |
| 2 | 0 | 1 | 0 | 1 | 1 | 0 | 1 | 1 |
| 3 | 0 | 1 | 0 | 0 | 1 | 1 | 1 | 1 |
| ∫ | | | | | | | | |
| 9 | 0 | 1 | 1 | 0 | 1 | 1 | 1 | 1 |

FIG. 6 is a block diagram illustrating major portions of the control apparatus which is constituted by the central processing unit 11 through up to the elevator equipments 18 of FIG. 1 to produce a position indication signal that drives the position indicator 17.

In FIG. 6, reference numeral 1 denotes a cage position detecting means which produces cage position signals FS in the order of first floor, second floor, - - - successively with the lowermost floor as floor zero, reference numeral 51 denotes a position indicator data setting means which sets position indicator data stored in the data ROM 5, and reference numeral 3 denotes a position indicator signal producing means which receives outputs from the cage position detecting means 1 and from the position indicator data setting means 51. FIG. 7 is a flow chart illustrating the procedure for producing position indicator data in accordance with FIG. 6. Table 2 shows the contents of the position indicator data setting means 51 that will be referred to when the position indicator 17 of seven segments is to be turned on in a manner of "−1, 1, 2, 3, - - - " successively starting from the lowermost floor.

TABLE 2

| Address | Data (Hexadecimal notation) | Displayed content | Note |
|---|---|---|---|
| 4000 | 40 | — | for upper digit of floor zero |
| 4001 | 00 | blank | for upper digit of 1st floor |
| 4002 | 00 | blank | for upper digit of 2nd floor |
| 4003 | 00 | blank | for upper digit of 3rd floor |
| ∫ | ∫ | ∫ | ∫ |
| 4100 | 06 | 1 | for lower digit of floor zero |
| 4101 | 06 | 1 | for lower digit of 1st floor |
| 4102 | 5B | 2 | for lower digit of 2nd floor |
| 4103 | 4F | 3 | for lower digit of 3rd floor |
| ∫ | ∫ | ∫ | ∫ |

In this case, a digit is displayed by the position indicator 17 that is constructed as shown in FIG. 5. Two indicators are used to display the position of the elevator in two digits. Namely, each floor is displayed by an upper digit and a lower digit in a manner of, for example, −1, 1, 2, 3, - - - ".

In the case of this example, the lowermost floor of the building is displayed as "−1", i.e., the first basement is displayed as "−1". When the cage position signal FS produced by the cage position detecting means indicates floor zero, it means the first basement of the building and the position indicator 17 displays "−1".

The operation will now be described in conjunction with FIGS. 6 and 7. When the elevator is located at the lowermost floor (FS=0), a step 31*a* obtains an address (FS+4000)=4000 for an upper digit and the position indicator data setting means 15 picks up data of "40" (hexadecimal notation) with reference to Table 2. This data is produced by a step 32 as a data for an upper digit. Then, a step 33*a* obtains an address (FS+4100)=4100 for a lower digit, and the position indicator data setting means 51 picks up the data of "06" with reference to Table 2. This data is produced by a step 34*a* as a data for a lower digit. Therefore, the data for the upper digit is "40", the data for the lower digit is "06", and the position indicator 17 indicates "−1" based upon FIG. 5. Similarly, "1, 2, - - - " are successively displayed as the elevator ascends. The number of the underground floors differs depending upon the buildings. Therefore, the lowermost floor may change in a manner of "−2, −1, 1, - - - ".

According to the conventional apparatus for controlling an elevator constructed as described above, the data of position indicator must be changed depending upon the building environment. Namely, the data ROM must be prepared for each of the buildings requiring laborious work and increased cost. Moreover, since the data must be changed for each of the floors, there easily develops error.

That is, when the lowermost floor of the building is the first basement, the data of the position indicator must be set by the position indicator data setting means 51 as shown in Table 2. However, when the building environment is changed, i.e., when the lowermost floor of the building is changed, for example, the second basement, the data of address "4001" of Table 2 must be changed to "40", the data of address "4100" must be changed to "5B", the data of address "4101" must be changed to "06", the data of "4102" must be changed to "06", and the data of "4103" must be changed to "5B", so that the position indicator 17 makes a display in a manner of "−2, −1, 1, 2, 3, - - - ". For this purpose, the data ROM 5 must be prepared for each of the buildings.

The present invention was accomplished in order to eliminate the above-mentioned problems, and its object is to provide an apparatus for controlling an elevator which makes it possible to easily cope with the position indication of an elevator even when the elevator is installed in different types of buildings.

SUMMARY OF THE INVENTION

An apparatus for controlling an elevator according to the present invention comprises:

control data setting means for setting control data indicative of the building in which the elevator is installed and for generating a control signal representative thereof;

cage position detecting means for detecting position of a cage of the elevator to generate a cage position signal representative thereof; and cage position converter means connected to receive the control signal and the cage position signal for performing a predetermined logical operation to generate a converted cage position signal corresponding to the environment;

position indicator data setting means for setting a position indicator data representing the position of the cage in response to the converted cage position signal generated by the cage position converter means; and position indicator signal producing means for producing a position indicator signal on the basis of the converted cage position signal and the position indicator data.

The cage position converter means of the present invention executes a predetermined logical operation upon receipt of the control signal and the cage position signal, and produces a converted cage position signal for indicating the position of the elevator specific to the building where the elevator is installed.

DETAILED DESCRIPTION OF THE PREFERRED EMBODIMENTS

Figure 1:
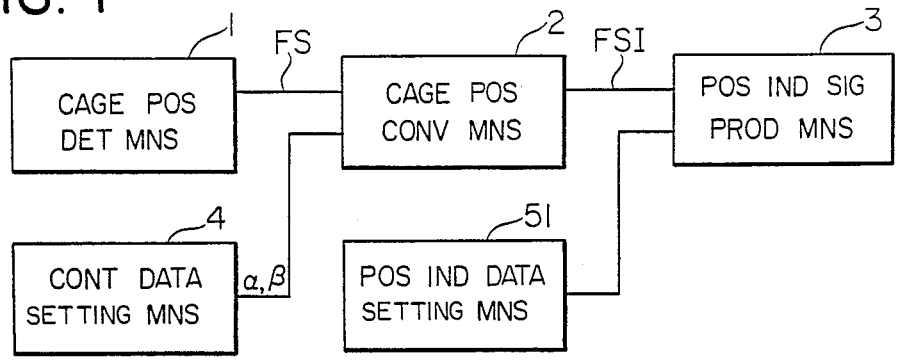
FIG. 1 is a block diagram illustrating a major portion of an apparatus for controlling elevator according to an embodiment of the present invention.
Figure 4:
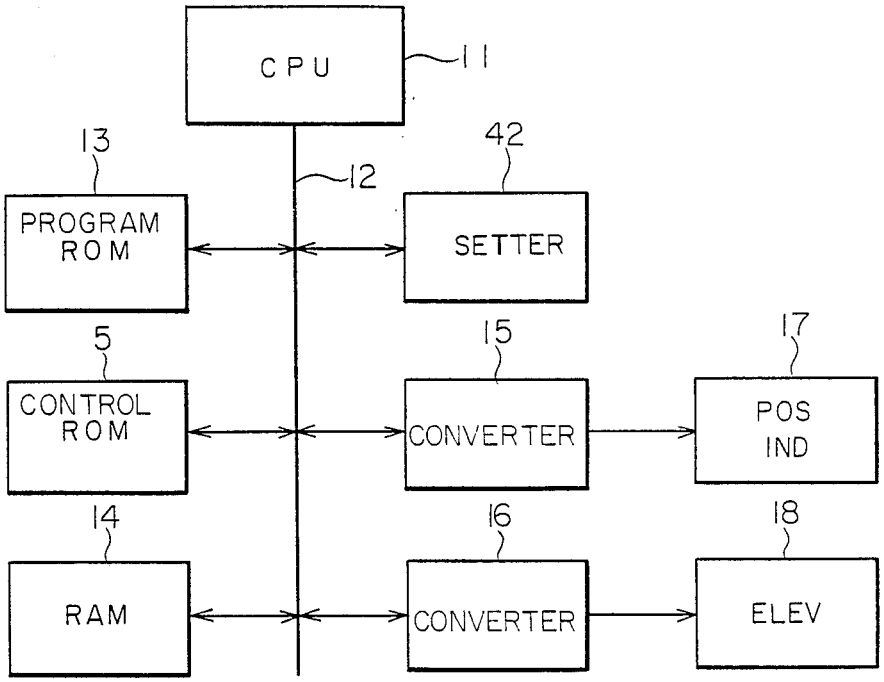
FIG. 4 (PRIOR ART)
FIG. 4 is a block diagram which schematically illustrates the apparatus for controlling elevator.
Figure 5:
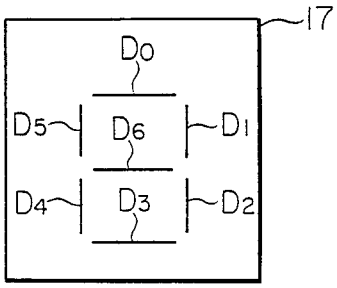
FIG. 5 is a diagram illustrating the arrangement of segments of a position indicator of FIG. 4.
Figure 6:
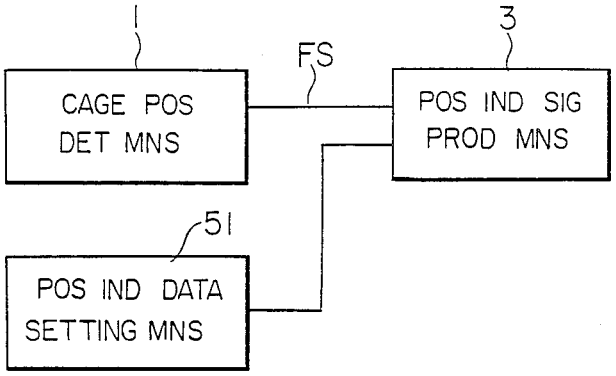
FIG. 6 (PRIOR ART)
FIG. 6 is a block diagram illustrating a major portion of a conventional apparatus for controlling an elevator.
Figure 7:
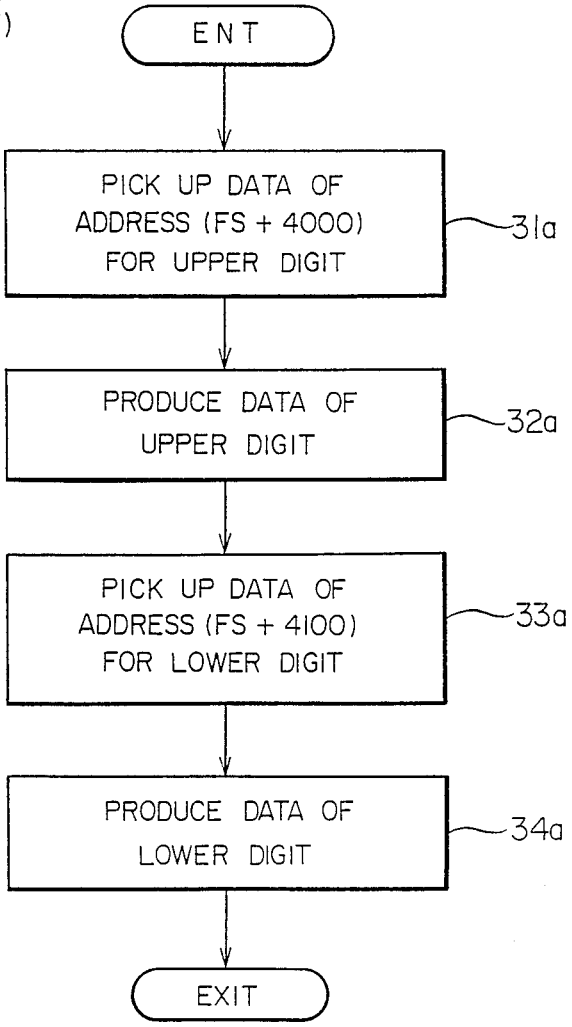
FIG. 7 (PRIOR ART)
FIG. 7 is a flow chart for explaining the operation of the control apparatus of FIG. 6.

An embodiment of the present invention will now be described in conjunction with the drawings. FIG. 1 is a block diagram illustrating an apparatus for controlling elevator according to the present invention. The cage position detecting means 1, position indicator signal producing means 3, and position indicator data setting means 51 are the same as those of FIG. 6. In FIG. 1, reference numeral 4 denotes a control data setting means for setting control data specific to each building, such as the entrance floor of a building, and reference numeral 2 denotes a cage position converter means which converts a cage position signal FS using the control data to produce a converted cage position signal FSI. Other portions are the same as those shown in FIGS. 4 and 6.

Figure 2:
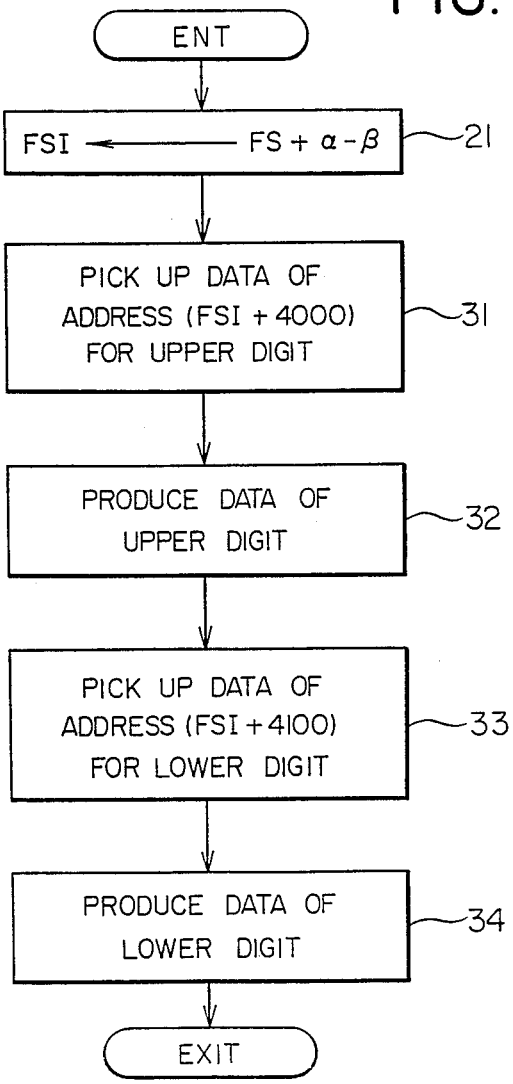
FIG. 2 is a flow chart for explaining the operation of the control apparatus of FIG. 1.

The operation will now be described. FIG. 2 is a flow chart which illustrates the operation of the control apparatus of FIG. 1. Data Table 3 shows the contents of the position indicator data setting means 51 for the case where the position indicator 17 has seven segments is used. When the position indicator data shown in Table 3 is used, $\alpha$ is set to be 9. When the lowermost floor of the building is the first basement, $\beta$ is set to be 1.

When the elevator car is at the lowermost floor, the cage position signal FS is zero from FIG. 2 and Table 3. A step 21 therefore finds a cage position FSI for the position indicator to be, $$(FSI)=(FS)+(\alpha)-(\beta)=0+9-1=8$$

A step 31 obtains an address (FSI+4000)=4008 for an upper digit, and the position indicator data setting means 51 picks up the data "40" which is then produced by a step 32 as an output for the upper digit. Then, a step 33 finds an address for a lower digit to be (FSI+4100)=4108, and the position indicator data setting means 51 picks up the data "06" which is then produced by a step 34 as an output for the lower digit. Relying upon the data "40" and "06", the position indicator 17 selects segments with reference to Table 3, and displays "−1". In the same manner, the position indicator displays "1, 2, - - - " successively as the elevator ascends. When the lowermost floor of the building is the second basement, $\beta$ is set to be 2. Even in this case, the position indicator displays "−2" in the same manner when the elevator is located on the lowermost floor.

TABLE 3

| Address | Data (hexadecimal number) | Note |
|---|---|---|
| 4000 | 40 | −9 for upper digit |
| 4001 | 40 | −8 for upper digit |
| ∫ | ∫ | ∫ |
| 4008 | 40 | −1 for upper digit |
| 4009 | 00 | 1 for upper digit |
| ∫ | ∫ | ∫ |
| 40FF | 00 | R for upper digit |
| 4100 | 6F | −9 for lower digit |
| 4101 | 7F | −8 for lower digit |
| ∫ | ∫ | ∫ |
| 4108 | 06 | −1 for lower digit |
| 4109 | 06 | 1 for lower digit |
| ∫ | ∫ | ∫ |
| 41FF | 80 | R for lower digit |

That is, a value "$\alpha$" is set by the control data setting means 4 depending upon the data that is set by the position indicator data setting means 51 and that is stored in the data ROM 5 as position indicator data. When the position indicator data shown in Table 3 are used, $\alpha$ is set to be 9. Therefore, the value $\alpha$ changes depending upon a position indicator data that is set.

Further, the value "$\beta$" set by the control data setting means 4 changes depending upon the floor of the building. That is, when the lowermost floor of the building is the first basement or, in other words, when the entrance floor of the building is the second floor as counted from the lowermost floor, $\beta$ is set to be 1. When the lowermost floor of the building is the second basement or, in other words, when the entrance floor of the building is the third floor as counted from the lowermost floor, $\beta$ is set to be 2.

Figure 3:
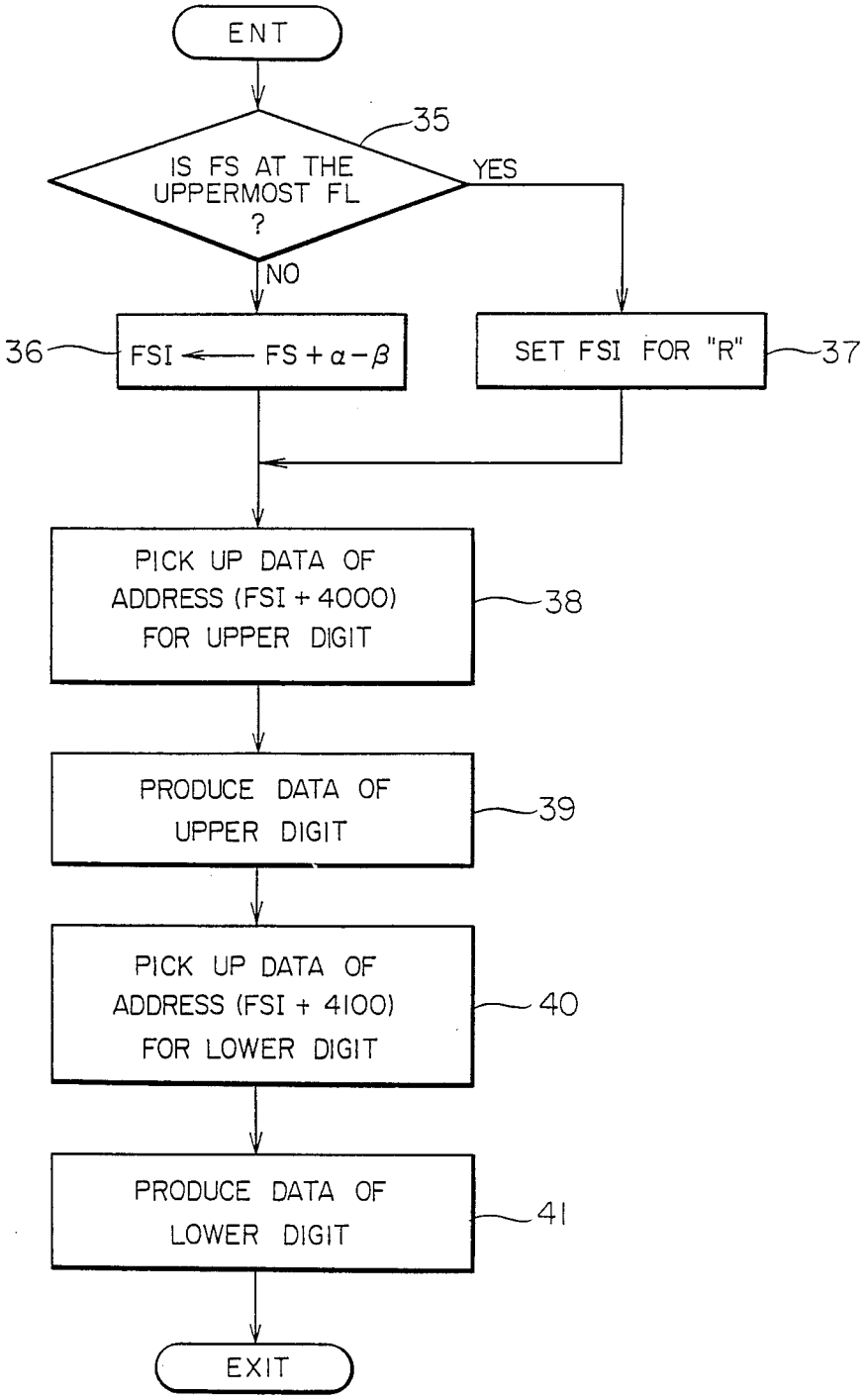
FIG. 3 is a flow chart for explaining the operation of the elevator control apparatus according to another embodiment of the present invention.

FIG. 3 is a flow chart illustrating the processing of the cage position converter means 2 and of the position indicator signal producing means 3 according to another embodiment of the present invention. Refering to the Fig., a step 35 determines whether the elevator is located at the uppermost floor or not. When the determined result is "no", a step 36 executes the same processing as that of the step 21 of the aforementioned embodiment. When the determined result is "yes", a step 37 sets (FSI)=FF for "R". Therefore, address "00" for the upper digit is obtained through steps 38 and 39, address "41FF" for the lower digit is obtained through steps 40 and 41, data "80" is picked up, and "R" is displayed on the position indicator 17.

Here, "R" cannot be displayed on the digital position indicator having seven segments. Therefore, a special position indicator is provided, and the indication "R" is controlled by the data for eight segments. Further, whether the elevator is located at the uppermost floor or not is calculated from the number of the floors where the elevator is put into service.

Though the above embodiments have dealt with the cases of seven segments, the same also holds true even in the cases of 16 segments and dot system to exhibit the same effects as those of the aforementioned embodiments.

Further, though the basements were displayed as "−1, −2", they may also be displayed as "B1, B2, - - - ". Moreover, any kind of display may be employed to obtain the same effects as those of the above-mentioned embodiments.

According to the present invention which executes a predetermined logical operation upon receipt of the control signal and the cage position signal as described above, there can be easily displayed the position of the elevator specific to the environment where the elevator is installed. Moreover, the apparatus can be cheaply constructed while maintaining improved reliability.

What is claimed is:

1. An apparatus for controlling an elevator comprising:

control data setting means for setting control data indicative of an environment where the elevator is installed and for generating a control signal representative thereof;

cage position detecting means for detecting position of a cage of the elevator to generate a cage position signal representative thereof;

cage position converter means connected to receive said control signal and said cage position signal for performing a predetermined logical operation to generate a converted cage position signal corresponding to said environment;

position indicator data setting means for setting a position indicator data representing the position of the cage in response to the converted cage position signal generated by said cage position converter means; and position indicator signal producing means for producing a position indicator signal on the basis of said converted cage position signal and said position indicator data.

2. An apparatus for controlling an elevator according to claim 1 wherein said cage position converter means performs a logical operation given by $$FS+\alpha-\beta$$

where FS denotes the cage position signal position detecting means, and $\alpha$ and $\beta$ denote control data indicative of the environment set by said control data setting means.

3. An apparatus for controlling an elevator according to claim 2 wherein said cage position detecting means detects a lowest position of the cage and generates a cage position signal indicative of a floor level of zero.

4. An apparatus for controlling an elevator according to claim 3 wherein said control data setting means sets the control data $\alpha$ based upon the position indicator data set by said position indicator data setting means.

5. An apparatus for controlling an elevator according to claim 4 wherein said control data setting means set the control data based upon the cage position signal indicative of the floor zero.

6. An apparatus for controlling an elevator according to claim 1 further including a position indicator connected to receive said position indicator signal for displaying corresponding cage position.

7. An apparatus for controlling an elevator according to claim 6 wherein said position indicator is a seven-segment indicator.

8. An apparatus for controlling an elevator according to claim 6 wherein said position indicator is an eight-segment indicator.

9. An apparatus for controlling an elevator according to claim 6 wherein said position indicator is a sixteen-segment indicator.

* * * * *